US006817684B2

(12) United States Patent
Cattaneo

(10) Patent No.: US 6,817,684 B2
(45) Date of Patent: Nov. 16, 2004

(54) ACCESSORY FOR FITTING AUXILIARY COMPONENTS FOR A WORK STATION BELOW A WORK SURFACE

(75) Inventor: Carlo Cattaneo, Figino Serenza (IT)

(73) Assignee: Leonardo S.r.l., Figino Serenza (IT)

( * ) Notice: Subject to any disclaimer, the term of this patent is extended or adjusted under 35 U.S.C. 154(b) by 22 days.

(21) Appl. No.: 10/198,641

(22) Filed: Jul. 17, 2002

(65) Prior Publication Data

US 2003/0020381 A1 Jan. 30, 2003

(30) Foreign Application Priority Data

Jul. 25, 2001 (IT) ..... MI2001A1600

(51) Int. Cl.[7] ..... A47B 97/00
(52) U.S. Cl. ..... 312/223.6; 108/50.02
(58) Field of Search ..... 403/363, 381, 403/326, 327, 329, 321, 322.1, 325, 265, 267, 268; 256/65.18; 248/317; 312/245, 194, 195, 208.1, 223.3, 223.6; 108/50.02

(56) References Cited

U.S. PATENT DOCUMENTS

| | | | | | |
|---|---|---|---|---|---|
| 3,129,751 | A | * | 4/1964 | Weber | 160/345 |
| 4,025,019 | A | * | 5/1977 | Jacobsen et al. | 248/317 |
| 4,101,183 | A | * | 7/1978 | McManus | 312/195 |
| 4,382,642 | A | * | 5/1983 | Burdick | 312/194 |
| 4,736,919 | A | * | 4/1988 | Bessinger | 248/250 |
| 4,748,913 | A | * | 6/1988 | Favaretto et al. | 108/50.02 |
| 5,934,203 | A | * | 8/1999 | Glass | 108/156 |
| 5,961,129 | A | * | 10/1999 | Post et al. | 280/7.13 |
| 5,971,509 | A | | 10/1999 | Deimen et al. | |
| 6,352,037 | B1 | * | 3/2002 | Doyle | 108/20 |
| 6,410,855 | B1 | * | 6/2002 | Berkowitz et al. | 174/101 |
| 6,619,765 | B2 | * | 9/2003 | Visser et al. | 312/194 |

FOREIGN PATENT DOCUMENTS

| | | |
|---|---|---|
| DE | 44 37 229 | 4/1996 |
| DE | 197 33 435 | 2/1999 |
| DE | 198 48 392 | 12/1999 |
| DE | 198 48 854 | 4/2000 |
| WO | WO 01 50913 | 7/2001 |

* cited by examiner

*Primary Examiner*—Janet M. Wilkens
(74) *Attorney, Agent, or Firm*—Hedman & Costigan, P.C.

(57) ABSTRACT

An accessory for fitting work station auxiliary components (14–19) below a work surface (13) which has at least one profile (12) adapted to be fixed below a work surface (13) wherein said profile (12) extends horizontally along the surface (13) and includes at least one attachment element (20–26) for joining the auxiliary components (14–19) to the profile (12), wherein the location of the auxiliary components (14–19) along said profile (12) is interchangeable, and wherein the profile (12) and the at least one attachment element (20–26) are joined using snap-engagement fasteners (28–30)

19 Claims, 6 Drawing Sheets

12
13
20'
20
31
14
22
16
29
29
21

ACCESSORY FOR FITTING AUXILIARY COMPONENTS FOR A WORK STATION BELOW A WORK SURFACE

The present application claims priority to Italian Patent Application Serial No. MI 2001A 001600, filed Jul. 25, 2001.

BACKGROUND OF THE INVENTION

The present invention refers to an accessory for fitting auxiliary components for a workstation below a work surface.

As is well known to experts of the sector workstations must be equipped with a high number of auxiliary components, distributed in a small space.

Indeed, also in a minimum configuration of a work station there is in any case a personal computer and connection cables between the units of the personal computer and to the mains.

Workstations having a larger number of auxiliary components can for example be equipped with filing drawers and vertical screening panels.

Moreover, the sector requires a high flexibility in configurations and arrangements of work surfaces, which constitute the workstation, also arranged at an angle to each other.

Work stations are often realised through the composition of work surfaces and legs, without the side shoulders against which to mask for example the cables or against which to connect filing drawers or other.

Therefore, there has been an increased need to foresee an organisation of the space, for example below the work surface, for the positioning of the auxiliary components.

Currently the space under a work surface is mainly exploited to fix the cables through clips or grooves. Other auxiliary components such as filing drawers, or keyboard-holding elements, possibly fixed below the work surface of a work station, are for example screwed directly onto the surface itself or in any case each have their own attachment system and therefore are not interchangeable.

The main drawback of the attachment systems currently used consists of the lack of a common attachment system available to all of the auxiliary components.

Moreover, in the case of reorganisation of a work station, the modification of the arrangement of the auxiliary components is very difficult from the point of view of the work necessary and in general can be carried out a limited number of times, with it being necessary to make new holes in the surface.

SUMMARY OF THE INVENTION

The general purpose of the present invention is that of overcoming the aforementioned drawbacks of the prior art in an extremely simple, cost-effective and particularly functional manner.

Another purpose is that of realising an accessory for fitting auxiliary components for a workstation below a work surface which constitutes a standard attachment system which can be applied to multiple uses.

In view of the aforementioned purposes, according to the present invention, it has been thought of to realise an accessory having the characteristics outlined in the attached claims.

BRIEF DESCRIPTION OF THE DRAWINGS

The structural and functional characteristics of the present invention and its advantages compared to the prior art shall become even clearer from an examination of the following description, referring to the attached drawings, which show an accessory realised according to the innovative principles of the invention itself.

In the drawings.

DETAILED DESCRIPTION OF THE INVENTION

Figure 1:
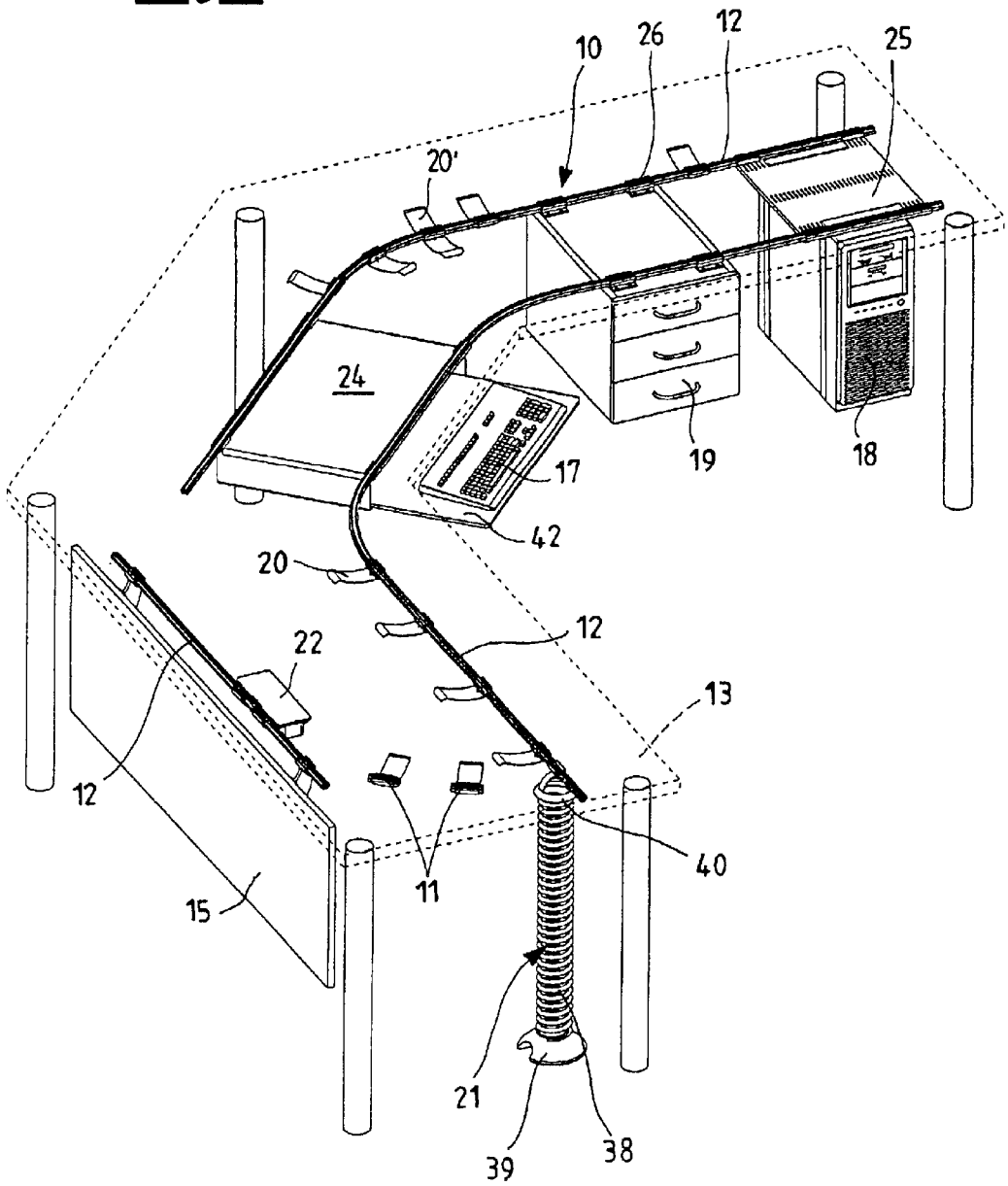
FIG. 1 shows an overall perspective view of a first configuration of a work station provided with an accessory for fitting auxiliary components below a work surface, object of the present invention.

With reference to the drawings, an accessory for fitting auxiliary components for a work station below a work surface, in object is wholly indicated with 10 and, in the example illustrated according to the present invention, comprises one or more profiles 12, or profile sectors 11, capable of being fixed below a surface 13 and a plurality of different elements for attaching auxiliary components.

By auxiliary components for a work station we mean for example cables 14, vertical screening panels 15, electrical sockets, telephone sockets or other sockets 16, keyboards 17 and other units of a personal computer 18, filing drawers 19 and other auxiliary material which can be secured to the surface 13.

Figure 2:
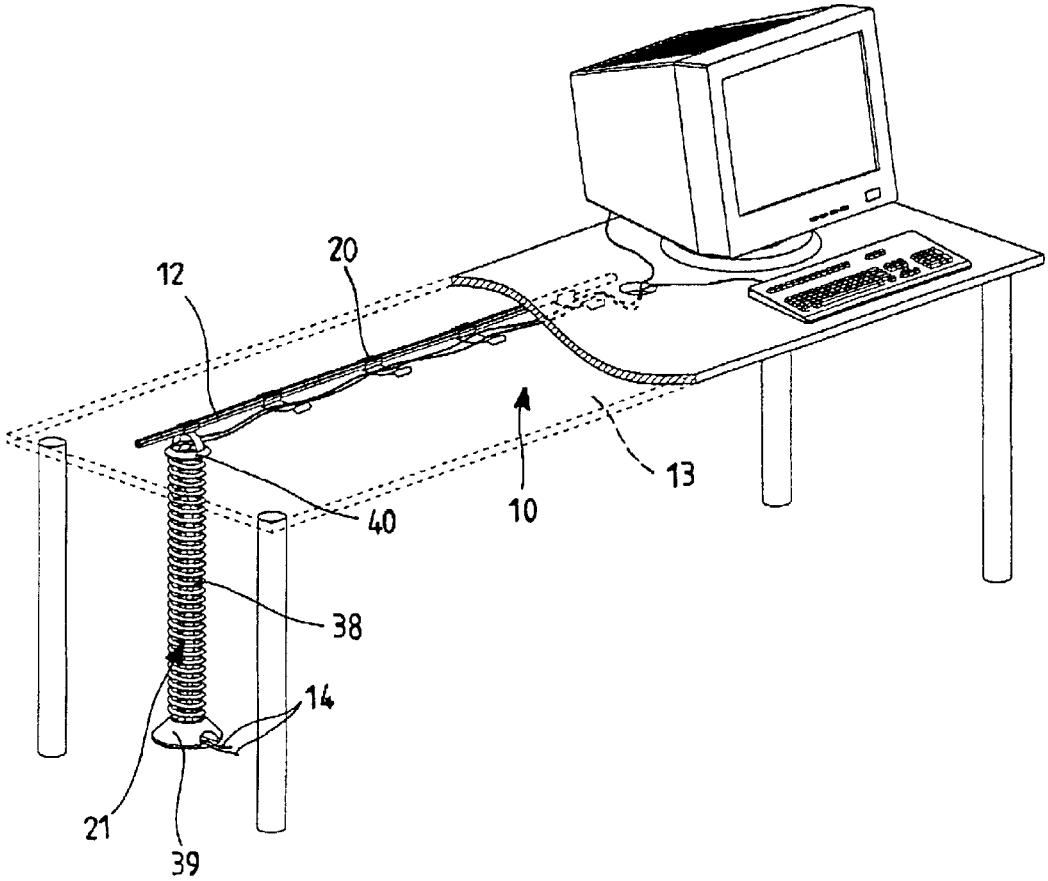
FIG. 2 is a perspective view of a second simplified configuration of a workstation equipped with an accessory, object of the present invention.

As shown in FIGS. 1 and 2 the elements for attaching auxiliary components of a work station are for example cable-carrying elements adhering to the surface, or horizontal, 20 and 20', as well as vertical cable-carrying elements 21, rectangular supports 22 for electrical sockets 16, brackets 23 for attachment with a screw of vertical panels 15, keyboard-carrying elements 24, support panels 25 for units of a personal computer 18 and universal attachments 26 with a screw 44.

The profile 12 and the attachment elements have additional snap-engagement means which stably bind them in the vertical direction still maintaining a radial clearance 27, which allows the relative translation in the longitudinal direction between the profile 12 and the attachment elements.

Figure 3:
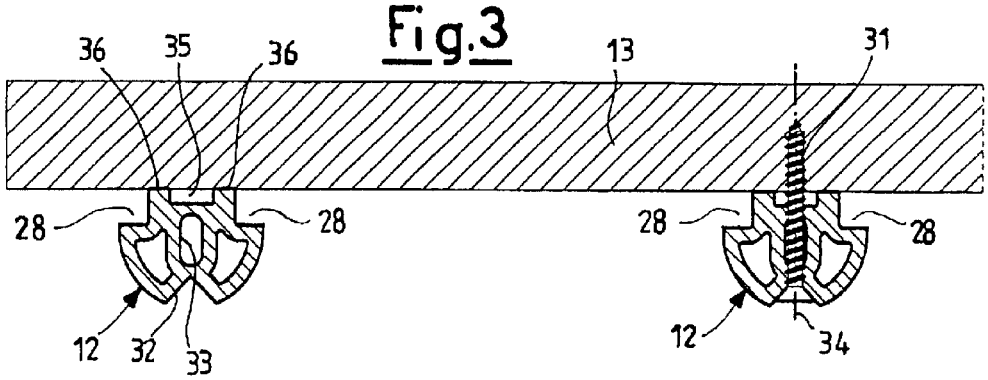
FIG. 3 is a cross-section of a detail of a work surface of a work station carrying a glued profile and a profile connected through screws.
Figure 4:
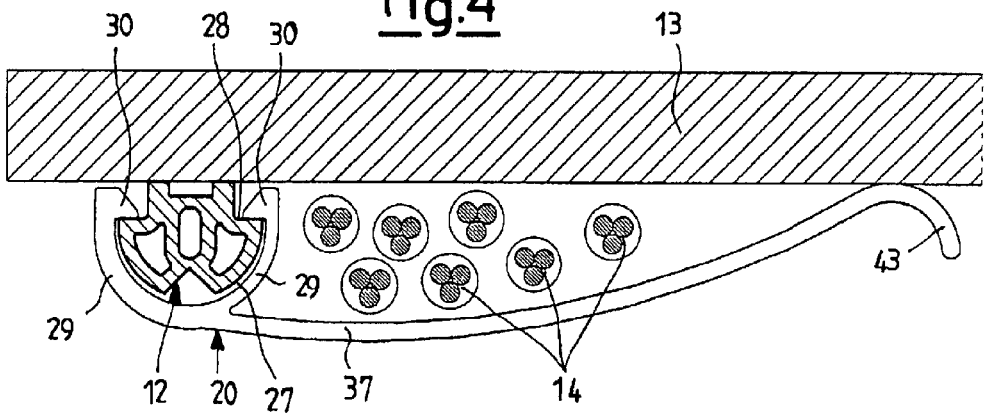
FIG. 4 shows a cross-section view of an element for attaching auxiliary elements consisting of a cable-guide in the realisation of an arm.
Figure 5:
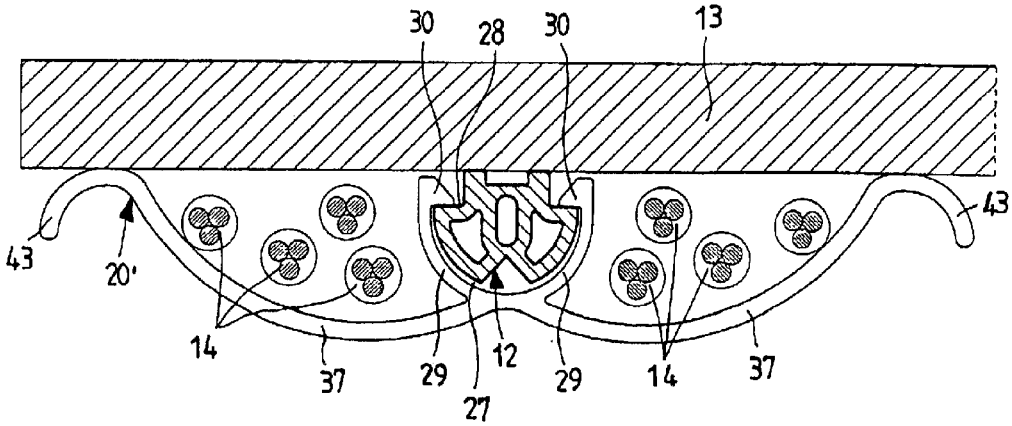
FIG. 5 shows a cross-section view of a second embodiment of a cable-carrier with two arms.

In an embodiment, shown in section just as an example in FIGS. 3–5, the profile 12 has an undercut to form a longitudinal L-shaped seat 28, formed on both sides, which constitutes one of the additional snap-engagement means.

The attachment elements, on the other hand, are equipped with additional snap-engagement means consisting of elastic walls 29, which have the outer shape of the profile and which terminate with a toothed element 30.

The profile 12, for example made out of plastic material, can either be flexible or rigid. In the first case, shown in FIG. 1, the profile 12 shall be applied below the surface 13 of an angled workstation, so as to follow the curved shape of the surface.

Should the profile 12 be rigid, through the combination of rectilinear profile sectors 11 and portions curved in a suitably predetermined manner it is possible to reach an analogous result in terms of rationalising the space and the distribution of auxiliary components under a work surface 13.

The profile sectors 11, of various sizes, can moreover be applied to the surface 13 for the localised attachment of an auxiliary component, for example a cable-guide 20, according to that which is shown in FIG. 1.

The attachment of the profile 12 to the surface 13 takes place for example through screws 31 applied in different points according to the shape of the workstation.

Therefore, the profile 12 can also not be prepunched, but in a preferred embodiment, according to that which is shown in section in FIG. 3, has a longitudinal slot 32 with a V-shaped section to receive the attachment screw 31 and for housing for the head of such a screw 31.

Moreover, there is an inner guide cavity 33 for the screw, arranged along an active axis 34 of said screw 31.

On the top the profile 12 is equipped with a space for collecting shavings 35 of wood and/or plastic generated from the action of the attachment screw 31 against the profile 12 itself and the surface 13 during assembly.

The profile 12, made according to that which has been outlined, is moreover suitable for being stuck to the surface for example through double-sided adhesive tape, should the application of small loads be foreseen on the attachment elements for auxiliary components.

Indeed, regarding this on the upper side of the profile flat surfaces 36 are arranged for sticking the profile 12 itself in contact with the surface 13.

Observing the aforementioned attachment elements for auxiliary components in greater detail, FIGS. 4 and 5 show the horizontal cable-guiding elements 20 and 20', equipped with one or two flexible arms 37. The arms 37, which extend along the side of the walls 29 of the engagement means with the profile 12, terminate with a curved portion 43 for containing the cables 14.

Through such horizontal cable-guides 20 and 20' it is possible to arrange more or less voluminous bundles of cables 14 under a surface 13 of a work station, according to suitable routes, keeping them as adhered as possible to such a surface so that they are not visible.

Moreover, the cable-guides 20' with two arms 37 allow the separation of different types of cables 14.

The vertical cable-guide 21 consists, in the example shown, of a flexible helix 38, capable of adapting to surfaces 13 of different heights, inside which the bundle of cables 14 is arranged which from the collection point under the surface is conveyed to the floor for connection to the mains.

A further non-shown embodiment of the cable-guide 21 could consist of a bellows-type tubular wall.

Figure 6:
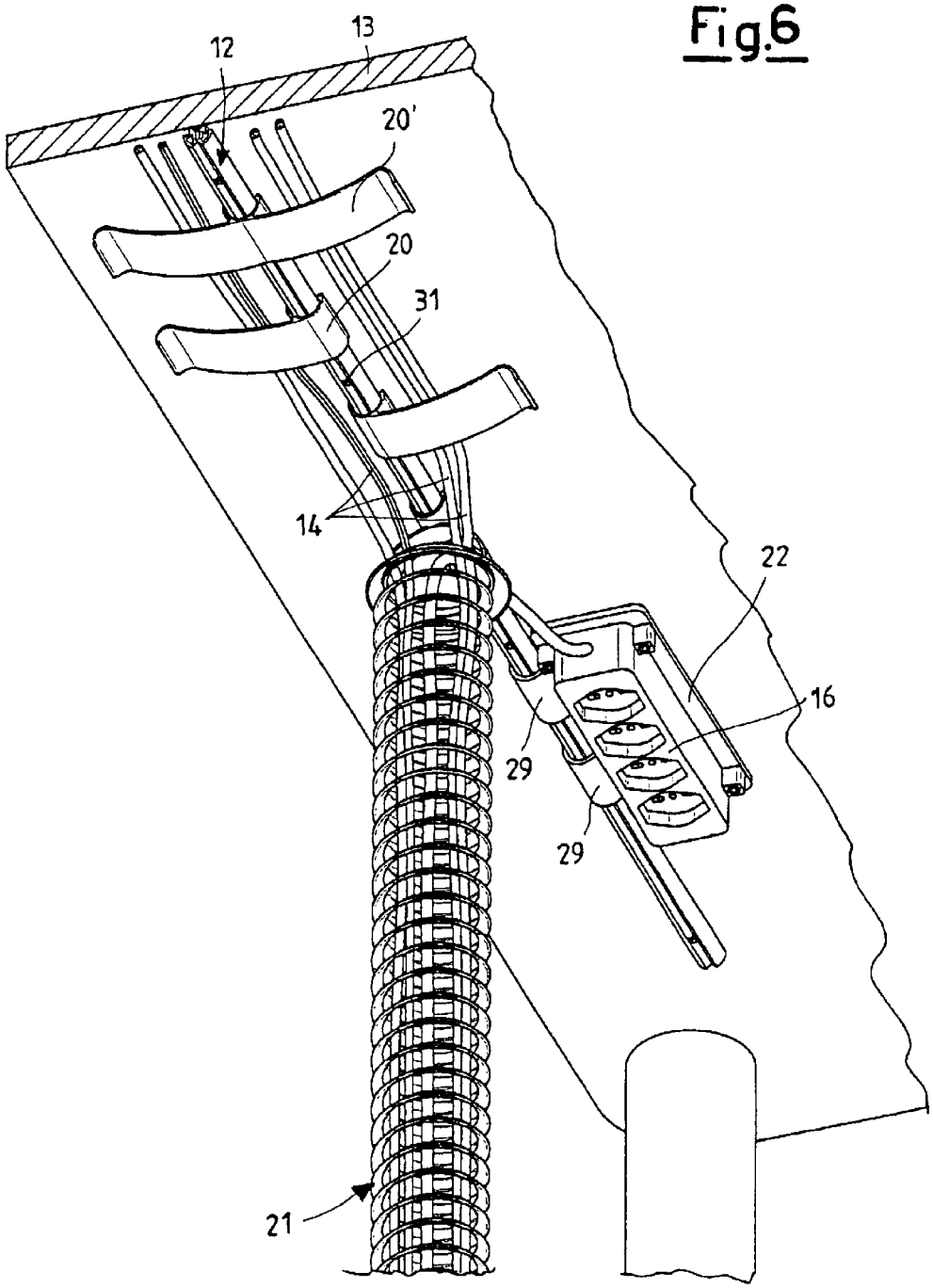
FIG. 6 is a perspective view from below showing a detail of an example arrangement under a work surface of some elements for attaching auxiliary components, such as cable-carriers adhering to the surface, a helical cable-carrier and a support for electrical sockets.

The vertical cable-guide 21 shown in FIGS. 1 and 6 terminates with a conical support element 39 and is equipped at the opposite end with an element for connection 40 with the walls 29.

The cables 14 can possibly originate from the power, telephone or personal computer sockets 16 fixed below the surface 13 and screwed into the rectangular support 22, carrying on one side one or more means for engagement with the profile 12 (FIG. 6).

Figure 7:
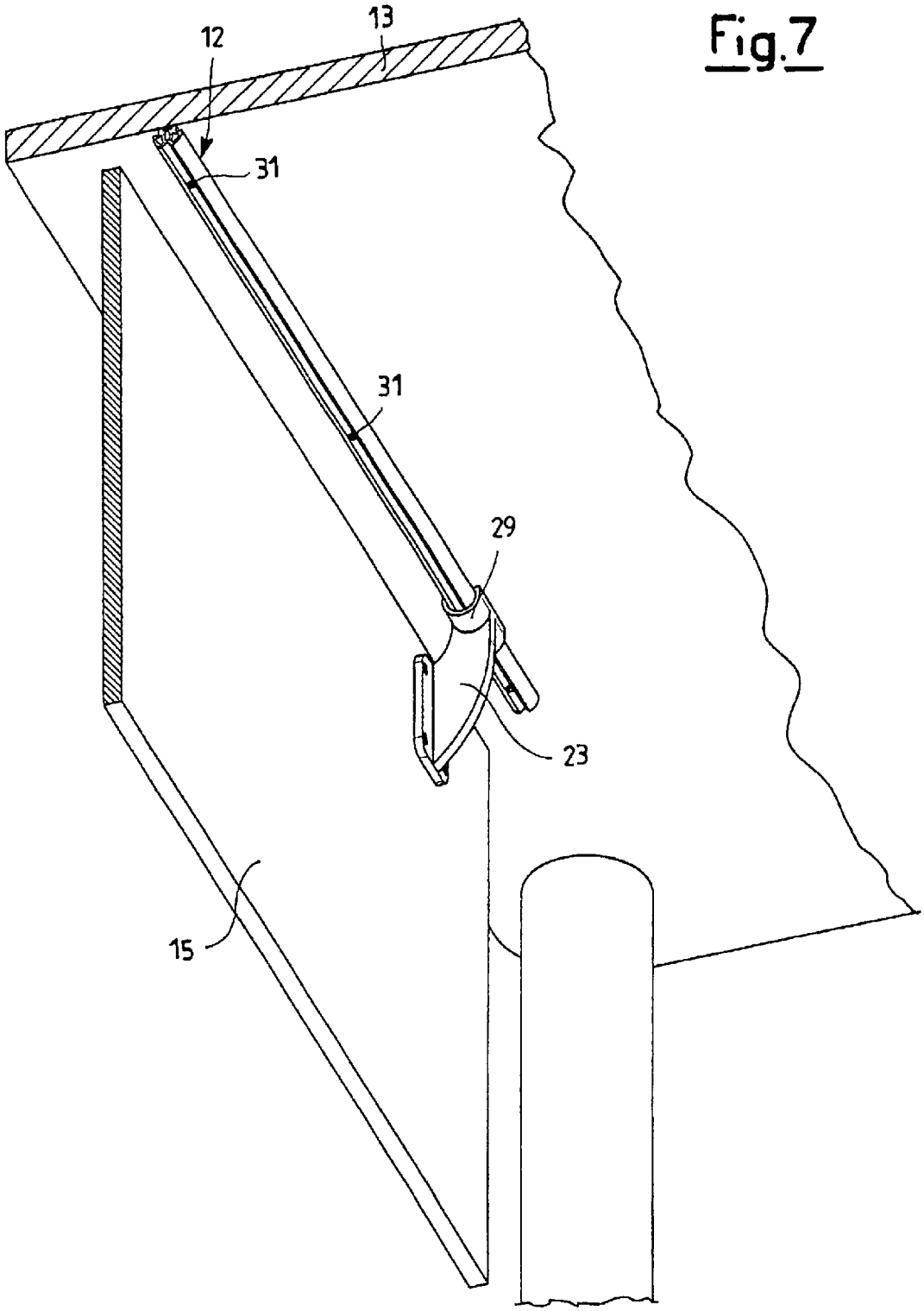
FIG. 7 is a perspective view from below showing a detail of the application of a screening panel to a surface.

Further attachment elements for auxiliary components consist of brackets 23 for attachment for example through screws of vertical screening panels 15, capable of being positioned opposite the operator's station, as shown in FIG. 7.

Figure 8:
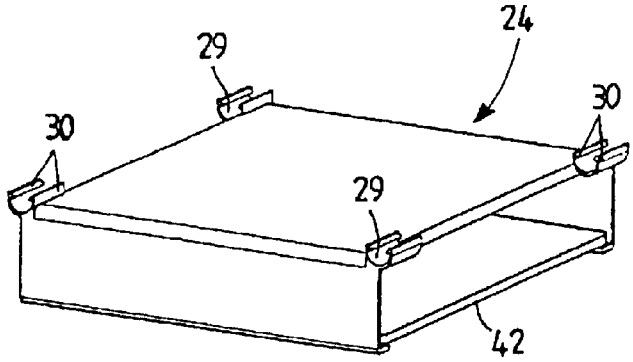
FIGS. 8–10 show perspective views, exploded with respect to the profiles, of further elements for attaching auxiliary components—a keyboard-holding element, a support panel for a personal computer and a universal screw attachment, respectively.

Finally, the keyboard-holding element 24, for example consisting of a space with a sliding base 42, shown in FIG. 8 isolated from the profiles 12, can be applied to such parallel profiles 12 through engagement means arranged at its corners.

Figure 9:
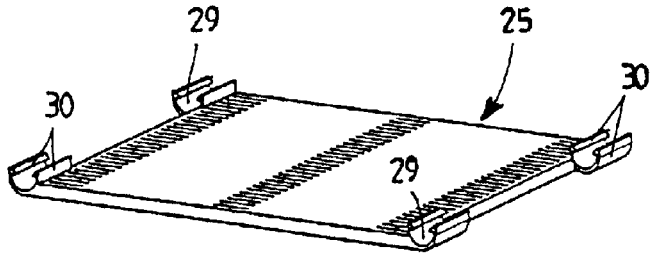

A further type of attachment element for auxiliary components, suitable for being simultaneously bound to two parallel profiles 12, consists of the support panel 25 for units of a personal computer or other peripheral units 18 (FIG. 9).

Figure 10:
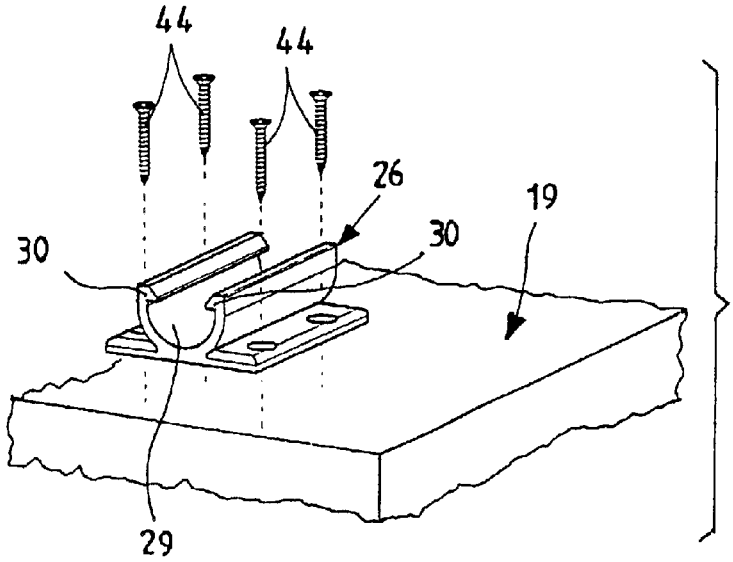

Finally, a plurality of universal screw attachments 26, an example of which is shown in FIG. 10, can be applied to furniture accessories, such as filing drawers 19 or other, so as to distribute the weight to be borne over many generically directed profiles 12.

The additional snap-engagement means of the attachment elements, which consist of the elastic walls 29 terminating with the toothed element 30, can for example be made integral with the attachment elements or be stably connected to them through fixed or separable clamps.

The attachment elements for auxiliary components as well as the profiles 12 can for example be made out of moulded plastic material, die-cast aluminium or other materials which combine strength, elasticity and ease of treatment.

The accessory for fitting auxiliary components for a work station 10 below a work surface, object of the present invention, is applied to surfaces 13 by means of screws 31 or is stuck to it, according to variable configurations for each surface.

The attachment elements for auxiliary components are snap-bound to the profile 12 through the additional engagement means.

The attachment elements thus assembled are allowed to translate longitudinally with respect to the profile 12, to be positioned in a more suitable manner with respect to any technical and aesthetic requirement and possibly to be withdrawn from the profiles themselves.

The horizontal cable-guides 20 and 20', equipped with one or more flexible arms 37 allow, moreover allow one or more cables 14 to be advantageously added or eliminated without having to disassemble the entire cable-guide element 20 and 20' for this.

Moreover, the vertical cable-guide 21, equipped with the flexible helix 38 is suitable, thanks to its shape, to surfaces 13 of different heights and can possibly also convey the cables 14 between two points, which are not on the same vertical.

From that which is described above with reference to the figures, it is clear how an accessory for fitting auxiliary components for a workstation below a work surface according to the invention is particularly useful and advantageous. The purpose mentioned in the preamble of the description is thus achieved.

Moreover, such an accessory shall advantageously be used to gain an excellent aesthetic result and to optimise the organisation of the space under the surface with any type of work station.

Moreover, the accessory object of the present invention allows the arrangement of the auxiliary components and of the electrical cables to easily be modified at a later date taking up the minimum amount of time and material.

Of course, the shapes of the accessory for fitting auxiliary components for a work station below a work surface object of the invention can be different from those shown purely as a non-limiting example in the drawings, just as the materials can be different.

The scope of protection is therefore defined by the attached claims.

What is claimed is:

1. Accessory (10) for fitting work station auxiliary components (14–19) below a work surface (13), comprising at least one profile (12) adapted to be fixed below said surface (13) wherein said profile (12) extends horizontally along said surface (13), said accessory (10) further comprising at least one attachment element (20–26) adapted for joining said auxiliary components (14–19) with said profile (12), wherein the location of said auxiliary components (14–19) along said profile (12) is interchangeable, and wherein said profile (12) and said at least one attachment element (20–26) are joined using snap-engagement means (28–30) said snap-engagement means consisting of at least one longitudinal seat (28) of said profile (12) and elastic walls (29) which terminate with a toothed element (30).

2. Accessory (10) according to claim 1, wherein said snap-engagement means (28–30) are integral or stably connected to attachment elements (20–26).

3. Accessory (10) according to claim 1, wherein between said profile (12) and said elastic walls (29) a radial clearance (27) is provided which allows relative translation between said profile (12) and said attachment elements (20–26).

4. Accessory (10) according to claim 1, wherein said profile (12) is flexible.

5. Accessory (10) according to claim 1, wherein said profile (12) is rigid and has a rectilinear shape or curved shape with predetermined bending radius.

6. Accessory (10) according to claim 1, wherein said profile (12) is equipped with a longitudinal cable (32) for receiving an attachment screw (31) of said profile (12) and for housing the head of said screw (31).

7. Accessory (10) according to claim 1, wherein said profile (12) is equipped with an inner guide cavity (33) for an attachment screw (31), where said cavity (33) is arranged along an active axis (34) of said screw (31).

8. Accessory (10) according to claim 1, wherein said profile (12) is equipped with a space for collecting shavings (35) generated by the action of an attachment screw (31) of said profile (12).

9. Accessory (10) according to claim 1, wherein said profile (12) comprises an upper side and a lower side, said profile (12) being equipped on said upper side with flat surfaces (36) for sticking said profile (12) in contact with said surface (13).

10. Accessory (10) according to claim 1, wherein said at least one attachment element for auxiliary components consists of a cable-guide element (20, 20'), equipped with at least one arm (37).

11. Accessory (10) according to claim 10, wherein at least one arm (37) is flexible.

12. Accessory (10) according to claim 1, wherein said at least one attachment element for auxiliary components consists of a support (22) for electrical sockets (16) or other sockets.

13. Accessory (10) according to claim 1, wherein said at least one attachment element for auxiliary components consists of brackets (23) for attaching vertical screening panels (15).

14. Accessory (10) according to claim 1, wherein said at least one attachment element for auxiliary components consists of a keyboard-holding element (24).

15. Accessory (10) according to claim 1, wherein said at least one attachment element for auxiliary components consists of a support panel (25) for a personal computer (18).

16. Accessory (10) according to claim 1, wherein said at least one attachment element for auxiliary components consists of at least one universal attachment (26) for connection through screws (44) of said auxiliary components.

17. Accessory (10) according to claim 1, wherein said auxiliary components consist off cables (14), vertical panels (15), electrical sockets (16), keyboards (17), personal computer units (18) and filing drawers (19).

18. Accessory (10) according to claim 1, further comprising profile sectors (11) capable of being fixed below said surface (13) said accessory (10) further comprising at least one attachment element (20–26) adapted for joining said auxiliary components (14–19) with said profile sector (11), wherein said profile (11, 12) and said at least one attachment element (20–26) have snap-engagement means (28–30).

19. Accessory (10) for fitting auxiliary components (14–19) for a work station below a work surface (13), comprising at least one profile (12) or profile sectors (11) capable of being fixed below said surface (13) and at least one attachment element (20–26) adapted for joining said auxiliary components (14–19) to said profile (12), wherein the location of said auxiliary components (14–19) along said profile (12) is interchangeable, and wherein said profile (11, 12) and said at least one attachment element (20–26) are joined using snap-engagement means (28–30), wherein said at least one attachment element for auxiliary components consists of a flexible vertical cable-guide element (21) with an adaptable height.

* * * * *